US006698951B2

(12) United States Patent
Kitai et al.

(10) Patent No.: US 6,698,951 B2
(45) Date of Patent: Mar. 2, 2004

(54) PAPER JAM DETECTION SYSTEM FOR FOLDING MACHINE

(75) Inventors: Mitsuo Kitai, Yokohama (JP); Takashi Iijima, Yokosuka (JP); Makoto Tsunashima, Kawasaki (JP); Yoshihiro Iwahashi, Kawasaki (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 10/201,258

(22) Filed: Jul. 24, 2002

(65) Prior Publication Data

US 2003/0109368 A1 Jun. 12, 2003

(30) Foreign Application Priority Data

Dec. 6, 2001 (JP) ..... P2001-372552

(51) Int. Cl.[7] ..... B41J 3/42; B41F 15/04; B26D 7/06; B65N 7/02

(52) U.S. Cl. ..... 400/74; 101/115; 101/116; 101/118; 101/130; 83/447; 83/648; 83/174; 271/258; 271/259

(58) Field of Search ..... 400/74; 101/116, 101/118, 115, 130; 358/1.16, 1.1; 83/485, 447, 648, 174; 271/258, 259

(56) References Cited

U.S. PATENT DOCUMENTS

| | | | | | |
|---|---|---|---|---|---|
| 3,878,398 | A | * | 4/1975 | Nellis | 250/559.4 |
| 5,081,490 | A | * | 1/1992 | Wakao | 399/17 |
| 5,322,274 | A | * | 6/1994 | Takahashi et al. | 271/258.01 |
| 5,423,528 | A | * | 6/1995 | Teranishi et al. | 271/111 |
| 5,431,077 | A | * | 7/1995 | Murakami | 83/162 |
| 5,528,351 | A | * | 6/1996 | Tsuji | 399/322 |
| 5,544,580 | A | * | 8/1996 | Takahashi | 101/118 |
| 5,717,836 | A | * | 2/1998 | Horie | 358/1.1 |
| 5,774,763 | A | * | 6/1998 | Muramatsu | 399/69 |
| 5,850,589 | A | * | 12/1998 | Cruz et al. | 399/341 |
| 5,893,559 | A | * | 4/1999 | Takahashi et al. | 271/280 |
| 5,944,645 | A | * | 8/1999 | Kobayashi | 493/16 |
| 5,979,311 | A | * | 11/1999 | Kakurai et al. | 101/118 |
| 6,009,785 | A | * | 1/2000 | Ott | 83/447 |
| 6,032,944 | A | * | 3/2000 | Lee | 271/110 |
| 6,053,086 | A | * | 4/2000 | Smyth | 83/648 |
| 6,092,450 | A | * | 7/2000 | Dueck | 83/174 |
| 6,109,153 | A | * | 8/2000 | Dueck | 83/487 |
| 6,138,545 | A | * | 10/2000 | Dueck | 83/614 |
| 6,229,983 | B1 | * | 5/2001 | Sawada | 399/385 |
| 6,237,485 | B1 | * | 5/2001 | Fukai | 101/118 |
| 6,241,243 | B1 | * | 6/2001 | Ishida et al. | 271/258.01 |
| 6,360,983 | B1 | * | 3/2002 | Pumpe | 242/542 |
| 6,374,730 | B1 | * | 4/2002 | Kuratani et al. | 101/115 |
| 6,557,849 | B2 | * | 5/2003 | Wyss | 271/259 |

FOREIGN PATENT DOCUMENTS

JP 51-13155 4/1976

* cited by examiner

*Primary Examiner*—Andrew H. Hirshfeld
*Assistant Examiner*—Wasseem H. Hamdan
(74) *Attorney, Agent, or Firm*—Westerman, Hattori, Daniels & Adrian, LLP

(57) ABSTRACT

A paper jam detection system for a folding machine includes an interval signal generator for generating an interval signal which assumes ON and OFF levels alternately according to cutting intervals of a cutting cylinder; a signature detection mechanism including reflection plates each having a light reflection surface and being arranged circumferentially at an outer circumferential surface portion of a jaw cylinder and a photoelectric sensor adapted to generate a reflection plate detection signal upon detection of the reflection plate; and a control unit for outputting a paper jam signal on the basis of the interval signal and the reflection plate detection signal.

6 Claims, 5 Drawing Sheets

PAPER JAM DETECTION SYSTEM FOR FOLDING MACHINE

BACKGROUND OF THE INVENTION

1. Field of the Invention

The present invention relates to a paper jam detection system for a folding machine of a rotary press, which includes a cutting cylinder, a folding cylinder, a jaw cylinder, and a paper guide.

2. Description of the Related Art

Technology for detecting occurrence of paper jam at a folding cylinder or a jaw cylinder of a folding machine is disclosed in, for example, Japanese Utility Model Publication (kokoku) No. S51-13135.

The paper jam detection system for a folding machine disclosed in Japanese Utility Model Publication No. S51-13135 includes photoelectric sensors for detecting paper present on corresponding cylinders of the folding machine and pulse generators which rotate together with the corresponding cylinders and generate pulses over a rotational range in which paper is expected to be present on the cylinders. When the system fails to obtain an AND result of an output signal from the photoelectric sensor and an output signal from the corresponding pulse generator, the system judges that a paper jam has occurred.

According to the publication, in the case of a jaw cylinder, a paper jam detection system includes a photoelectric sensor provided in opposition to the outer circumferential surface of the jaw cylinder and adapted to output a signal upon detection of paper gripped by a jaw mechanism of the jaw cylinder; a signal generator provided on a shaft connected to the jaw cylinder and adapted to output a signal over a rotational range in which paper is expected to be present on the jaw cylinder; and a control unit for detecting occurrence of paper jam on the basis of a signal from the photoelectric sensor and a signal from the signal generator.

The photoelectric sensor emits light from a light emitter thereof. Emitted light reflects on paper when paper is present on the outer circumferential surface of the jaw cylinder, or reflects on the glossy outer circumferential surface of the jaw cylinder when paper is absent. Utilizing a difference in the quantity of reflected light therebetween, the photoelectric sensor outputs a signal to the control unit when paper is present.

The control unit has an AND circuit for carrying out the logical AND between a signal from the photoelectric sensor and a signal from the signal generator. When no paper is present on the jaw cylinder, no signal is output from the photoelectric sensor, and the AND condition is not satisfied. In this case, the control unit judges that a paper jam has occurred, and outputs a paper jam signal.

The above-described paper jam detection system for a folding machine involves the following problems.

1. When the outer circumferential surface of the jaw cylinder, on which light emitted from the photoelectric sensor is reflected, is smudged, the quantity of reflected light decreases, potentially causing detection error. In order to prevent this problem, a worker must clean the outer circumferential surface of the jaw cylinder so as to maintain cleanliness of the surface. This cleaning work is troublesome and time-consuming, thus imposing a burden on the worker.

2. The system for detecting occurrence of paper jam through detection of presence/absence of a sheet on the outer circumferential surface of the jaw cylinder is effective when applied to straight run, which is one folding mode of the folding machine (each of sheets cut from a web is transferred from the folding cylinder to the jaw cylinder to be gripped by the jaw mechanism of the jaw cylinder and then be folded, so that every jaw mechanism holds a sheet). However, the system is not applicable to collect run, which is another folding mode of the folding machine (two sheets which have been cut from a web having two different images alternately printed thereon and which carry different printed images are superposed on each other on the folding cylinder and then transferred to the jaw cylinder to be gripped by the jaw mechanism of the jaw cylinder and be folded, so that every other jaw mechanism grips two layered sheets).

In collect run, paper is not gripped by every jaw mechanism, but is gripped by every other jaw mechanism. Therefore, when a jaw mechanism which does not grip paper reaches the sensor position, the photoelectric sensor detects the outer circumferential surface of the jaw cylinder, not paper, and thus fails to output a detection signal. As a result, since the AND condition is not satisfied in the control unit, the control unit outputs a paper jam signal in spite of no paper jam having occurred in actuality, thereby rendering the system useless for collect run.

SUMMARY OF THE INVENTION

An object of the present invention is to solve the above-mentioned problems involved in the conventional paper jam detection system and to provide a paper jam detection system for a folding machine allowing easy and quick cleaning of a reflective surface that reflects light from a photoelectric sensor, exhibiting stable performance of paper jam detection through stable reflection, and capable of performing paper jam detection in both straight run and collect run.

A paper jam detection system of the present invention is applied to a folding machine of a rotary press in which a folding cylinder, a cutting cylinder, and a jaw cylinder are disposed such that an outer circumferential surface of the cutting cylinder and an outer circumferential surface of the jaw cylinder face an outer circumferential surface of the folding cylinder with gaps held therebetween for allowing passage of paper; axially extending knives project from the outer circumferential surface of the cutting cylinder; pairs each consisting of a cutting shoulder and a pin are circumferentially arranged at an outer circumferential surface portion of the folding cylinder such that the cutting shoulders are arranged at circumferential intervals corresponding to those of the knives of the cutting cylinder and such that the pins are located adjacent to and behind the corresponding cutting shoulders in relation to a rotational direction of the folding cylinder and can project from and retract behind the outer circumferential surface of the folding cylinder; each of axially extending tucker blades is circumferentially arranged at a substantially circumferentially central position between neighboring cutting shoulders in such a manner as to be able to project from and retract behind the outer circumferential surface of the folding cylinder; jaw mechanisms are circumferentially arranged at an outer circumferential surface portion of the jaw cylinder at circumferential intervals corresponding to those of the knives of the cutting cylinder; a paper guide is provided to define a sheet transfer space together with the outer circumferential surface of the folding cylinder and the outer circumferential surface of the jaw cylinder and guide a two-folded signature gripped by the jaw mechanism; and the knife and the cutting shoulder cooperatively cut off a sheet of predetermined length from a web, while the jaw mechanism and the tucker blade cooperatively fold the sheet.

The paper jam detection system comprises an interval signal generator for generating an interval signal which assumes alternately ON and OFF states according to cutting intervals of the cutting cylinder; a signature detection mechanism comprising reflection plates each having a light reflection surface and being provided at an outer circumferential surface portion of the jaw cylinder adjacent to and behind the corresponding jaw mechanism in relation to the rotational direction of the jaw cylinder such that the light reflection surface does not project beyond a contour of the outer circumferential surface of the jaw cylinder; and a photoelectric sensor adapted to generate a reflection plate detection signal upon detection of the reflection plate and located downstream, in relation to the rotational direction of the jaw cylinder, of an end of the paper guide on a side toward the jaw cylinder at a position suited for detecting the reflection plate with a gap held between the photoelectric sensor and the outer circumferential surface of the jaw cylinder; and a control unit for outputting a paper jam signal on the basis of the interval signal from the interval signal generator and the reflection plate detection signal from the photoelectric sensor.

Preferably, the control unit comprises a paper jam signal output section for a straight-run folding mode and a paper jam signal output section for a collect-run folding mode and selectively uses the paper jam signal output sections according to a folding mode. Further preferably, the paper jam detection system further comprises a detection circuit changeover unit for outputting to the control unit an instruction signal for instructing the control unit to select the paper jam signal output section for the straight-run folding mode or the paper jam signal output section for the collect-run folding mode.

Preferably, the paper jam signal output section for the straight-run folding mode judges occurrence of paper jam on the basis of ON and OFF levels of the interval signal and an ON level of the reflection plate, and the paper jam signal output section for the collect-run folding mode judges occurrence of paper jam on the basis of the ON level of the interval signal and the ON level of the reflection plate detection signal.

Preferably, the photoelectric sensor comprises a cover whose bottom panel faces a light emission-reception surface of the photoelectric sensor and has an opening formed therein for allowing passage of light and whose side panel has an air nozzle formed therein for allowing air from an air supply to impinge on the light emission-reception surface.

Since the paper jam detection system of the invention includes reflection plates each having a light reflection surface for reflecting light emitted from the photoelectric sensor, presence/absence of a signature can be detected efficiently and reliably, and cleaning of the light reflection surfaces is neither troublesome nor time-consuming, thereby reducing a burden imposed on a worker and enhancing work efficiency.

The paper jam detection system of the invention can detect paper jam in both folding modes of straight run and collect run.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

A paper jam detection system for a folding machine according to an embodiment of the present invention will next be described in detail with reference to the drawings.

Figure 1:
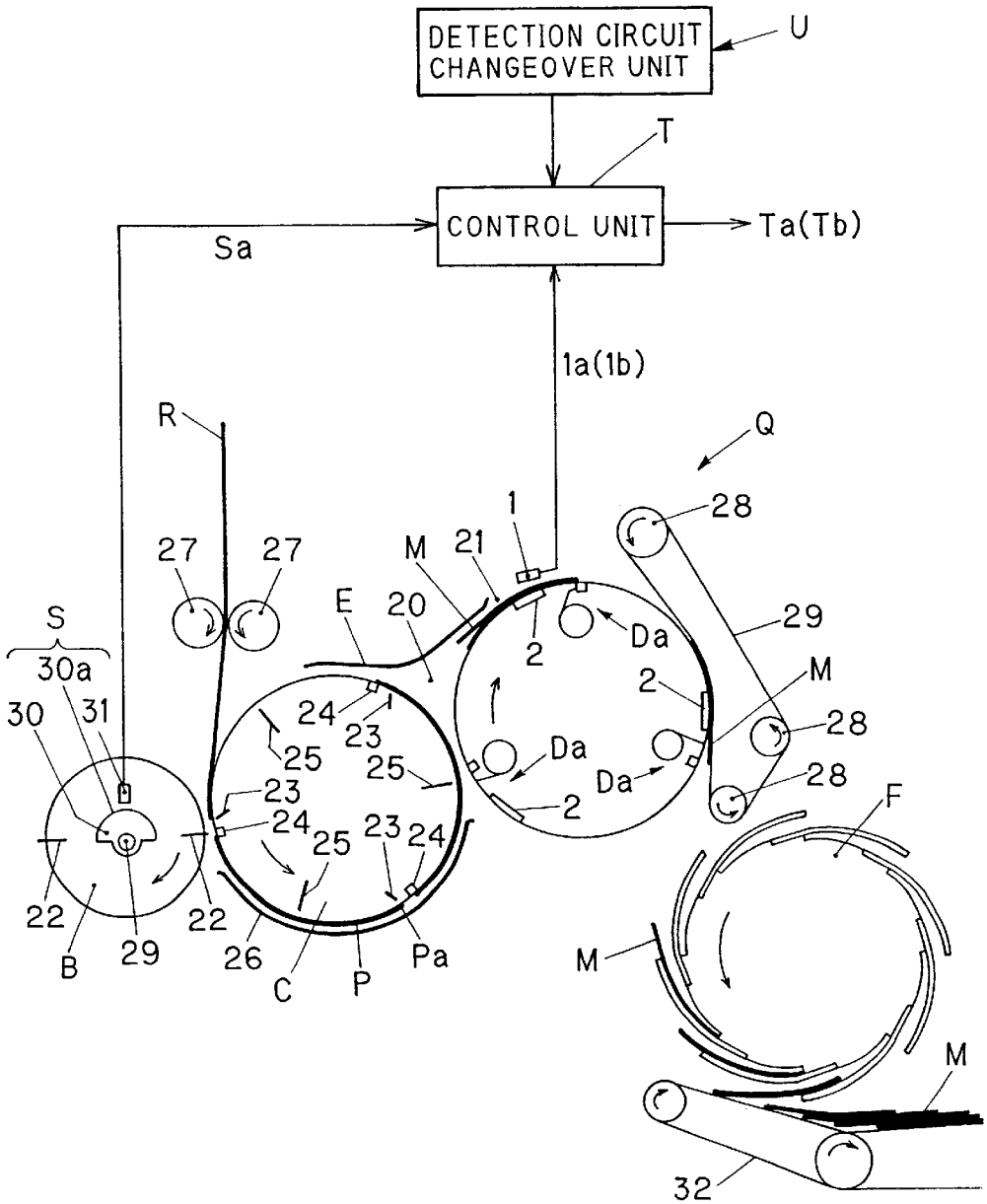
FIG. 1 is a schematic view showing the configuration of a paper jam detection system for a folding machine according to an embodiment of the present invention.

First, a folding machine to be equipped with a paper jam detection system will be described with reference to FIG. 1. As shown in FIG. 1, a folding machine Q of a rotary press includes a cutting cylinder B, a folding cylinder C, and a jaw cylinder D, which are arranged in parallel with one another such that the cutting cylinder B and the jaw cylinder D are disposed at opposite sides of the folding cylinder C.

A gap for allowing paper to pass through is formed between the cutting cylinder B and the folding cylinder C, and another gap for allowing paper to pass through is formed between the jaw cylinder D and the folding cylinder C. Two knives 22 project from the outer circumferential surface of the cutting cylinder B at positions shifted 180 degrees from each other. Pairs each consisting of a cutting shoulder 24 and a pin 23 are circumferentially arranged at an outer circumferential surface portion of the folding cylinder C at circumferential intervals each corresponding to half the circumferential length of the cutting cylinder B. The pins 23 are located adjacent to and behind the corresponding cutting shoulders 24 in relation to the rotational direction of the folding cylinder C, and can project from and retract behind the outer circumferential surface of the folding cylinder C. Each of tucker blades 25 is circumferentially disposed at a substantially circumferentially central position between neighboring cutting shoulders 24 in such a manner as to be able to project from and retract behind the outer circumferential surface of the folding cylinder C.

In FIG. 1, three pairs each consisting of the cutting shoulder 24 and the pin 23 are provided; three tucker blades 25 are provided; and the diameter of the folding cylinder C is three times the radius of the cutting cylinder B. The diameter of the jaw cylinder D is substantially equal to that of the folding cylinder C. Three jaw mechanisms Da each consisting of a movable jaw 3 and a stationary jaw 4 are disposed at an outer circumferential surface portion of the jaw cylinder D at circumferentially equal intervals.

Two facing nipping rollers 27 are disposed upstream of the paired cutting cylinder B and folding cylinder C in relation to the running direction of a web R in such a manner as to nip the web R to be fed. The nipping rollers 27 rotate at the same circumferential speed in opposite directions so as to feed the web R toward the gap between the cutting cylinder B and the folding cylinder C.

The cutting cylinder B, the folding cylinder C, and the jaw cylinder D rotate at the same circumferential speed as do the paired nipping rollers 27. A signature guide belt 29 is disposed opposite the folding cylinder C with respect to the jaw cylinder D in such a manner as to face the outer circumferential surface of the jaw cylinder D.

The signature guide belt 29 is looped around and mounted on an appropriate number of rollers (three rollers in the present embodiment) 28. A portion of the signature guide belt 29 is in contact with the outer circumferential surface of the jaw cylinder D. The signature guide belt 29 travels in the direction opposite the rotational direction of the jaw cylinder D; i.e., counterclockwise, at a speed equal to the circumferential speed of the jaw cylinder D.

A delivery fan F is provided underneath the signature guide belt 29.

The delivery fan F includes a number of vanes arranged circumferentially regularly in an obliquely radially extending manner, and is rotated counterclockwise about an axis extending perpendicular to the paper on which FIG. 1 appears. In a left-hand circumferential region of the delivery fan F, spaces each defined by adjacent vanes open upward so as to receive one after another signatures M, which are conveyed while being held between the jaw cylinder D and the signature guide belt 29 and then drop as a result of release from the corresponding jaw mechanisms Da.

A delivery conveyor 32 is provided underneath the delivery fan F. Being looped around and mounted on an appropriate number of rollers, the delivery conveyor 32 travels in the vicinity of the delivery fan F along an appropriate range of the outer circumference of the delivery fan F in the direction similar to the traveling direction of the outer circumference of the delivery fan F at a speed that maintains a predetermined relation with the circumferential speed of the delivery fan F.

A paper guide E is provided above the folding cylinder C and the jaw cylinder D while extending between a region in the vicinity of the outer circumferential surface of the folding cylinder C and a region in the vicinity of the outer circumferential surface of the jaw cylinder D; i.e., such that in FIG. 1 the paper guide E, the outer circumferential surface of the folding cylinder C, and the outer circumferential surface of the jaw cylinder D define a sheet transfer space 20 having a substantially triangular cross section.

The inner surface of the paper guide E faces the outer circumferential surface of the folding cylinder C and that of the jaw cylinder D while a gap is maintained therebetween. Particularly, the gap between the paper guide E and the jaw cylinder D is determined so as to allow passage of signature M, which is a sheet held by the jaw mechanisms Da in a folded state.

A paper guide 26 is disposed along the outer circumferential surface of the folding cylinder C over a range extending from a position in the vicinity of the narrowest gap between the cutting cylinder B and the folding cylinder C to a position in the vicinity of the narrowest gap between the jaw cylinder D and the folding cylinder C. The gap between the inner surface of the paper guide 26 and the outer circumferential surface of the folding cylinder C is determined so as to allow passage of a sheet P into which the pin 23 is stuck.

The paper jam detection system for the above-described folding machine will next be described.

As shown in FIG. 1, the paper jam detection system includes a signature detection mechanism A and an interval signal generator S. The signature detection mechanism A is composed of a photoelectric sensor 1, which is provided downstream of the paper guide E and faces the outer circumferential surface of the jaw cylinder D, and reflection plates 2, which are provided at an outer circumferential surface portion of the jaw cylinder D which faces the photoelectric sensor 1, at respectively predetermined positions. The interval signal generator S is provided on the cutting cylinder B, and is composed of a detection member 30 and a proximity switch 31.

The paper jam detection system further includes a control unit T provided at an appropriate position. The control unit T receives a detection signal from the photoelectric sensor 1, a detection signal from the proximity switch 31, and a detection circuit changeover signal from a detection circuit changeover unit U. When the control unit T judges from a detection signal from the photoelectric sensor 1 and that from the proximity switch 31 that a paper jam has occurred, the control unit T outputs a paper jam signal Ta or Tb to an unillustrated paper jam elimination mechanism.

The signature detection mechanism A, the interval signal generator S, and the control unit T will next be described.

1. Photoelectric Sensor 1

Figure 2:
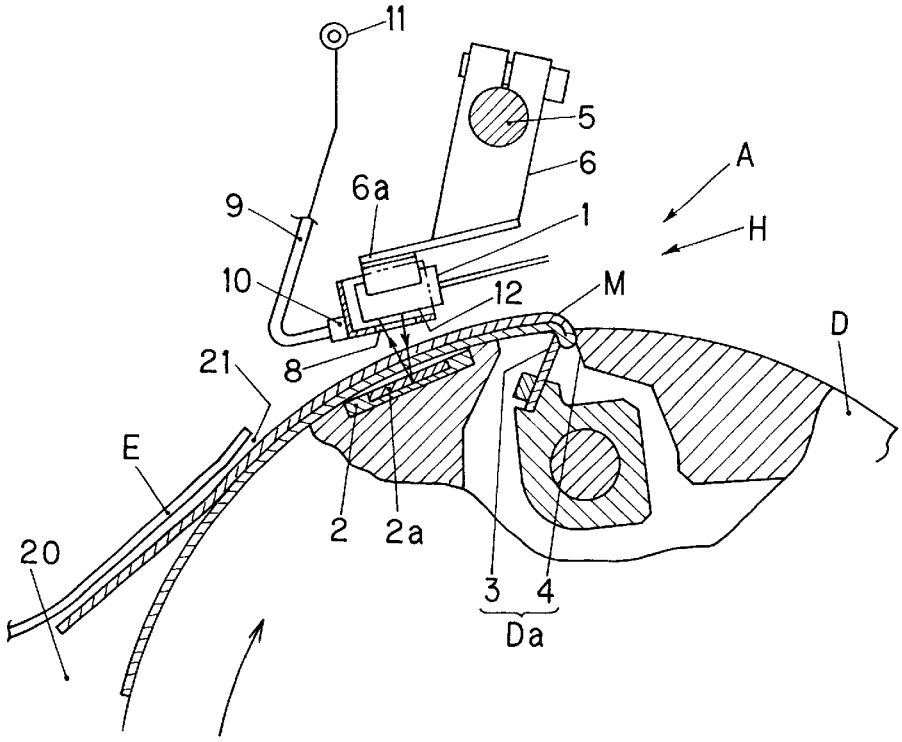
FIG. 2 is a partially enlarged view showing a main portion of the paper jam detection system of FIG. 1.
Figure 3:
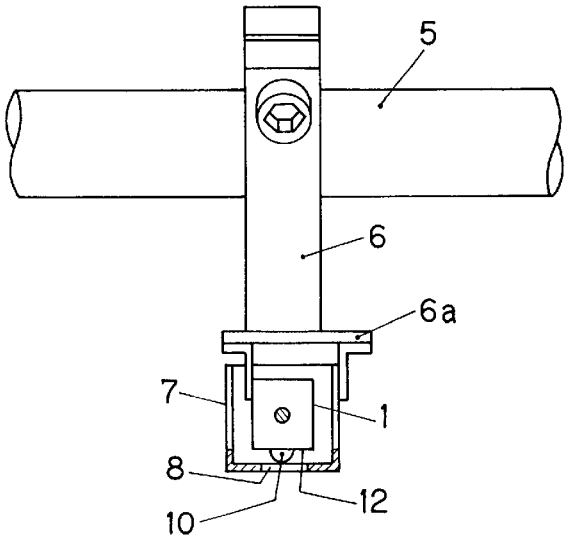
FIG. 3 is a view of a photoelectric sensor as viewed along arrow H of FIG. 2.

As shown in FIGS. 2 and 3, a shaft 5 is fixedly attached to a machine frame (not shown) in parallel with the axis of the jaw cylinder D, and is located above the jaw cylinder D. A base end portion of a bracket 6 is fixedly attached to the shaft 5. To an end plate portion 6*a* of the bracket 6 are fixedly attached the photoelectric sensor 1, which has a light emission-reception surface 12 and assumes the shape of a rectangular parallelepiped, and a cover 7, which covers four faces of the photoelectric sensor 1, excluding the top face and a side face located frontward in relation to the rotational direction of the jaw cylinder D.

The photoelectric sensor 1 is composed of a light emitter and a light receiver, and is located immediately downstream of a narrowest gap position 21 where the gap between the paper guide E and the jaw cylinder D is the narrowest, at a position allowing detection of the reflection plate 2, which will be described later, provided at an outer circumferential portion of the jaw cylinder D. An appropriate distance is maintained between the photoelectric sensor 1 and the outer circumferential surface of the jaw cylinder D in order to avoid contact with signature M which is gripped by the jaw mechanism Da and moves as the jaw cylinder D rotates. The light emission-reception surface 12 is composed of a light emission lens of the light emitter and a light reception lens of the light receiver, and faces signature M which passes by.

The bottom panel of the cover 7 faces the light emission-reception surface 12 of the photoelectric sensor 1, and has an opening 8 formed therein. A side panel of the cover 7 located rearward in relation to the rotational direction of the jaw cylinder D has a hole, which serves as an air nozzle 10, formed therein. The air nozzle 10 is connected to an air supply 11 by means of an air pipe 9.

The position of the air nozzle 10 is selected such that air supplied from the air supply 11 through the air pipe 9 impinges on the light emission-reception surface 12 of the photoelectric sensor 1.

When the folding machine Q is started, electricity is supplied to the photoelectric sensor 1, so that the photoelectric sensor 1 starts detecting operation. Simultaneously with the start of the photoelectric sensor 1, an unillustrated solenoid valve is switched in order to supply air from the air supply 11 to the air nozzle 10 formed in the cover 7, so that air is jetted from the air nozzle 10.

Thus-discharged air prevents adhesion of paper dust and other dust to the light emission-reception surface 12 of the photoelectric sensor 1, thereby maintaining the photoelectric sensor 1 in good detection condition.

Upon reception of light reflected from the reflection plate 2, which will be described later, the photoelectric sensor 1 outputs a detection signal 1*a* or 1*b* to the control unit T, which will be described later.

2. Reflection Plate 2

As shown in FIG. 2, the reflection plate 2 has a light reflection surface 2*a* and is provided at an outer circumferential surface portion of the jaw cylinder D at a position located behind the jaw mechanism Da in relation to the rotational direction of the jaw cylinder D and where the light reflection surface 2*a* is covered with signature M gripped by the jaw mechanism Da, such that the light reflection surface 2*a* does not project beyond the outer circumferential surface of the jaw cylinder D. The light reflection surface 2*a* faces the light emission-reception surface 12 of the photoelectric sensor 1 when the reflection plate 2 passes by the photoelectric sensor 1 as the jaw cylinder D rotates.

The size of the reflection plate 2 may be determined so as to be able to reflect light emitted from the light emitter of the photoelectric sensor 1 (e.g., a size slightly greater than that of the light emission-reception surface 12 of the photoelectric sensor 1).

3. Interval Signal Generator S

As shown in FIG. 1, the interval signal generator S includes the proximity switch 31 provided on, for example, an unillustrated machine frame, and the detection member 30 provided on a shaft 33 of the cutting cylinder B.

The detection member 30 is formed in such a manner as to turn alternately ON and OFF the proximity switch at intervals equal to cutting intervals of the cutting cylinder B.

In the present embodiment, the detection member 30 includes a semicircular large-diameter portion 30*a* which is concentric with the shaft 33. The proximity switch 31 is located where it can detects the outer circumferential surface of the large-diameter portion 30*a*.

The detection member 30 is mounted on the shaft 33 such that, when the reflection plate 2 provided at an outer circumferential surface portion of the jaw cylinder D is situated at a rotational position as shown in FIG. 1 where it is detected by the photoelectric sensor 1, a substantially circumferentially central portion of the outer circumferential surface of the large-diameter portion 30*a* comes to a rotational position where it is detected by the proximity switch 31.

While detecting the large-diameter portion 30*a* of the detection member 30, the proximity switch 31 outputs the interval signal Sa.

Specifically, the interval signal Sa assumes alternately ON and OFF states at intervals of one-half rotation of the cutting cylinder B. The photoelectric sensor 1 detects the reflection plate 2 of the jaw cylinder D at the timing of the center of the ON or OFF duration of the interval signal Sa.

The proximity switch 31 sends the interval signal Sa to the control unit T, which will be described later.

4. Detection Circuit Changeover Unit U

The detection circuit changeover unit U shown in FIG. 1 sends to the control unit T an instruction signal for instructing the control unit T to select the paper jam signal output section for straight run of the folding machine Q or the paper jam signal output section for collect run of the folding machine Q.

The detection circuit changeover unit U may be, for example, a selector switch (not shown) to be operated by a worker, or an appropriate changeover detection unit (not shown) which operates in an interlocking relation with a changeover mechanism (not shown) for changing over a folding mode of the folding machine Q between straight run and collect run. When the detection circuit changeover unit U outputs an instruction signal to the control unit T, the control unit T changes over the two paper jam signal output sections from one to the other accordingly.

5. Control Unit T

The control unit T shown in FIG. 1 includes a paper jam signal output section for straight run and a paper jam signal output section for collect run.

The paper jam signal output section for straight run judges occurrence of jamming of the sheet P on the basis of an interval signal Sa in an ON or OFF state and a reflection plate detection signal 1*a* in an ON state. The interval signal Sa is a signal generated by the proximity switch 31 of the interval signal generator S provided on the cutting cylinder B and indicative of whether or not the large-diameter portion 30*a* of the detection member 30 is detected. The reflection plate detection signal 1*a* is a signal generated by the photoelectric sensor 1 provided in the vicinity of the jaw cylinder D and indicative of whether or not the reflection plate 2 is detected.

The paper jam signal output section for collect run judges occurrence of jamming of the sheet P on the basis of the interval signal Sa in an ON state and the reflection plate detection signal 1*b* in an ON state.

Upon judgement that a paper jam has occurred, the paper jam signal output section for straight run or collect run outputs the paper jam signal Ta or Tb to an unillustrated paper jam elimination mechanism, which copes with paper jam.

Figure 4:
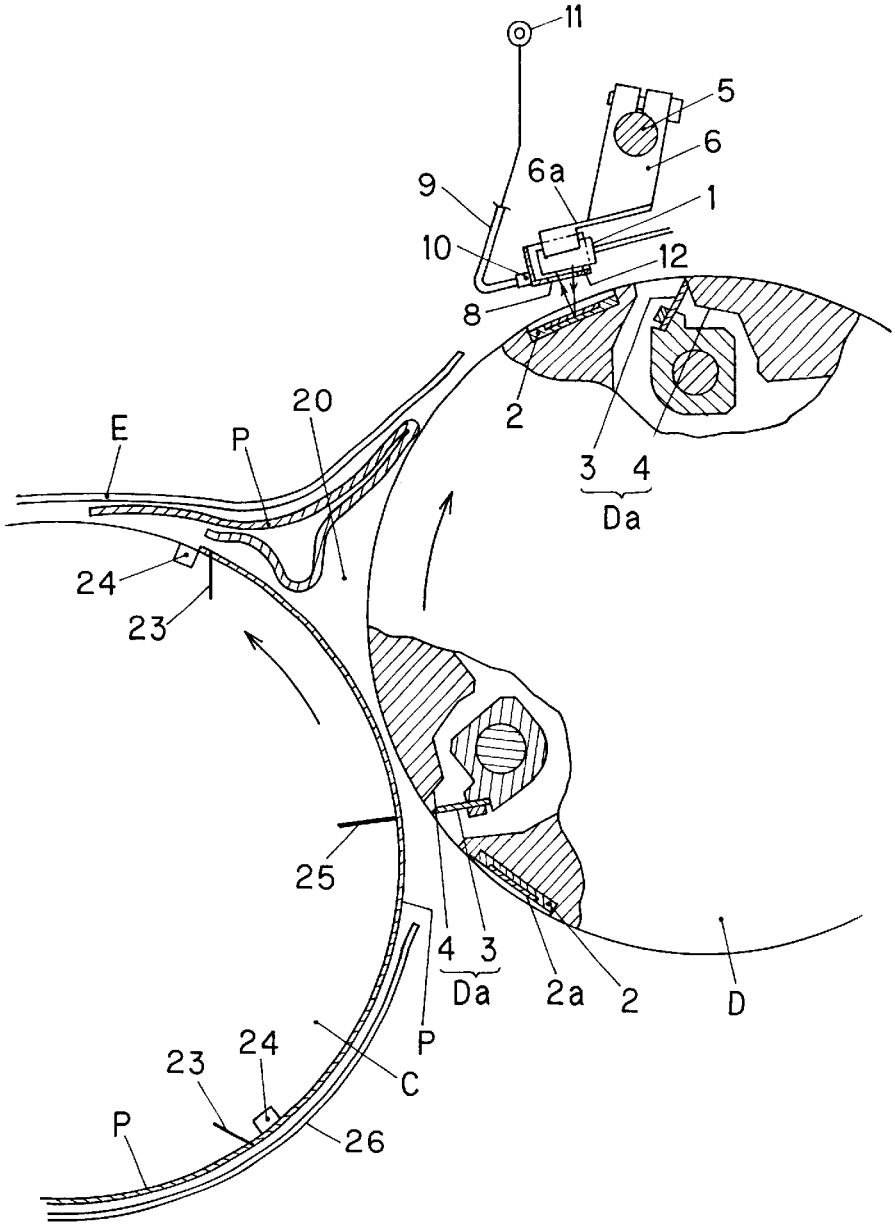
FIG. 4 is a partially sectional view showing the operation of the paper jam detection system of the embodiment.

The operation of the paper jam detection system during the folding machine Q being engaged in folding will next be described with reference to FIGS. 1, 2, and 4.

First, in FIG. 1, the rotary press including an unillustrated press unit and the folding machine Q is operated at low speed so as to thread the web R to the folding machine Q via the press unit.

Specifically, the nipping rollers 27 nip and pull the web R, which is threaded thereto via the press unit, to thereby thread the web R into the gap between the folding cylinder C and the cutting cylinder B. The cutting cylinder B and the folding cylinder C rotate clockwise and counterclockwise, respectively, such that the knife 22 of the cutting cylinder B synchronously meets the cutting shoulder 24 of the folding cylinder C. When the knife 22 and the cutting shoulder 24 meet, the web R is cut at a lead portion Pa. The pin 23 projecting from the outer circumferential surface of the folding cylinder C is stuck into the web R at a position located immediately behind the cut line.

As mentioned above, the pin 23 is stuck into the web R at a position located immediately behind the cut line; i.e., the pin 16 is stuck into the lead portion Pa. The lead portion Pa is led into the gap between the paper guide 26 and the outer circumferential surface of the folding cylinder C while a portion of the web R subsequent to the lead portion Pa is looped around and held on the outer circumferential surface of the folding cylinder C. Being pulled by the moving pin 23, the web R moves through the gap between the paper guide 26 and the outer circumferential surface of the folding cylinder C.

Then, when the knife 22 of the cutting cylinder B and the cutting shoulder 24 of the folding cylinder 24 meet, the subsequent portion of the web R is cut. As a result, the sheet P of predetermined length (in the illustrated example, ⅓ the circumferential length of the folding cylinder C) is cut off from the web R. Being pulled by the moving pin 23, the sheet P moves further through the gap between the paper guide 26 and the outer circumferential surface of the folding cylinder C. The lead portion Pa of the sheet P passes the narrowest gap between the outer circumferential surface of the folding cylinder C rotating counterclockwise and the outer circumferential surface of the jaw cylinder D rotating clockwise.

Subsequently, when a central portion of the sheet P, with respect to the feed direction thereof, and the tucker blade 25 reach the narrowest gap between the folding cylinder C and the jaw cylinder D, the jaw mechanism Da of the jaw cylinder D which is rotationally synchronized with the tucker blade 25 faces the tucker blade 25. The tucker blade 25 of the folding cylinder C projects from the outer circumferential surface of the folding cylinder C. As a result, the central portion of the sheet P is projected toward the jaw cylinder D to thereby be gripped by the jaw mechanism Da provided on the jaw cylinder D; i.e., the central portion is gripped between the movable jaw 3 and the stationary jaw 4. The tucker blade 25 which has projected immediately retracts.

Synchronously with or slightly before projection of the tucker blade 25, the pin 23 of the folding cylinder C which has held the lead portion Pa of the sheet P retracts behind the outer circumferential surface of the folding cylinder C to thereby be withdrawn from the lead portion Pa.

As the central portion of the sheet P gripped on the jaw cylinder D moves further as a result of rotation of the jaw cylinder D, the lead portion Pa of the sheet P begins to be pulled in the direction opposite the rotational direction of the folding cylinder C; i.e., the moving direction of the lead portion Pa reverses to thereby move toward the outer circumferential surface of the jaw cylinder D along the paper guide E.

As the central portion Q2 of the sheet P moves further through the gap between the paper guide E and the outer circumferential surface of the jaw cylinder D, the lead portion Pa of the sheet P moves from the outer circumferential surface of the folding cylinder C toward the jaw cylinder D within the sheet transfer space 20, which has a substantially triangular cross section and is defined by the outer circumferential surfaces of the folding cylinder C and the jaw cylinder D and the paper guide E extending between a region in the vicinity of the outer circumferential surface of the folding cylinder C and a region in the vicinity of the outer circumferential surface of the jaw cylinder D. The first half of the sheet P including the lead portion Pa and the second half of the sheet P subsequent to the central portion are drawn into the narrowest gap position 21, where the gap between the paper guide E and the jaw cylinder D is the narrowest, while being superposed on each other.

The sheet P is folded along the central portion gripped by the jaw mechanism Da to become a signature M. After moving through the gap between the paper guide E and the outer circumferential surface of the jaw cylinder D, the signature M moves further while being held between the outer circumferential surface of the jaw cylinder D and the signature guide belt 29 subsequent to a downstream end portion of the paper guide E. When the signature M reaches the position where the signature guide belt 29 and the outer circumferential surface of the jaw cylinder D move away from each other, the jaw mechanism Da of the jaw cylinder D releases the signature M; i.e., the movable jaw 3 moves away from the stationary jaw 4. The released signature M drops in a vertical posture.

Since intervals of releasing signatures M are identical to those of rotational movement of vanes of the rotating delivery fan F, dropping signatures M enter spaces defined by adjacent vanes one by one from heads. The signatures M received individually between adjacent vanes are conveyed while changing their postures as the delivery fan F rotates (counterclockwise). Upon arrival in a bottom region of the delivery fan F, the signatures M are removed one by one from between adjacent vanes of the delivery fan F and drop onto a delivery conveyor 32, which travels (rightward in FIG. 1) at a speed that maintains a predetermined relation with the circumferential speed of the rotating delivery fan F. The signatures M overlap one another at constant intervals on the conveyor 32 and are conveyed out from the folding machine Q in a row.

For the above-described various operations of the folding machine Q, such as threading of the web R, gripping of sheets P by jaw mechanisms Da of the jaw cylinder D, and transfer of signatures M from the delivery fan F to the delivery conveyor 32, printing preparation work; i.e., various adjustments, is carried out. The printing preparation work is performed, while the rotary press is operated at the lowest printing speed and stopped repeatedly.

After the printing preparation work is completed, the printing speed is gradually increased toward start of regular printing. In the course of increasing the printing speed, when a drive speed signal input to the control unit T from an unillustrated printing speed detector indicates that a predetermined printing speed (e.g., a speed slightly higher than the crawling speed, which is the lowest printing speed for adjustment) is reached, the control unit T starts paper jam detection operation on the basis of detection signals from the interval signal generator S and the photoelectric sensor 1.

Next, detection of paper jam by the control unit T will be described with reference to the timing chart shown in FIG. 5.

1. Detection of Paper Jam in Straight Run (FIG. 5A)

Figure 5A:
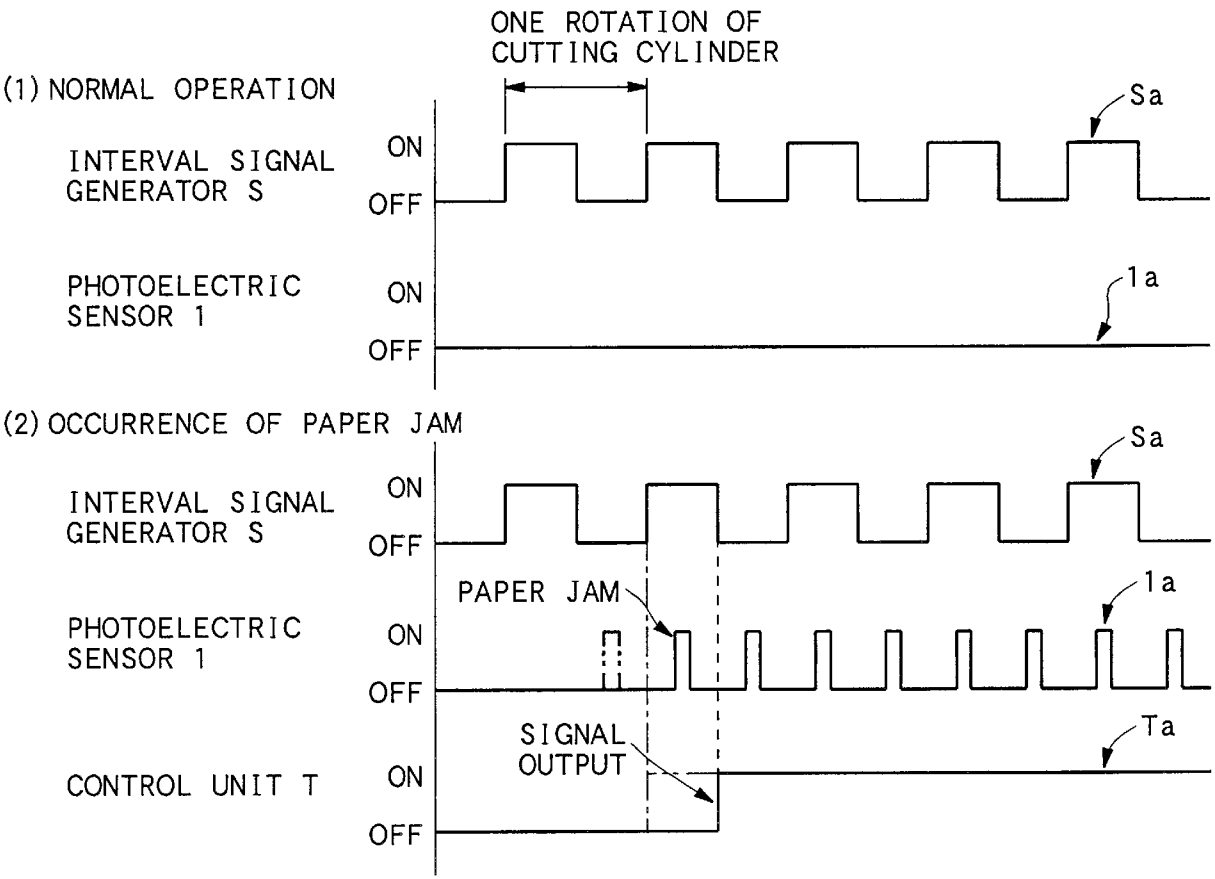
FIGS. 5A and 5B are timing charts showing paper jam detecting operations of a control unit of the embodiment.

FIG. 5A(1) shows a timing chart for the case where the folding machine Q operates normally in the straight run mode. The proximity switch 31 of the interval signal generator S outputs a proximity detection signal, which serves as the interval signal Sa and assumes ON and OFF levels alternately at intervals corresponding to one-half rotation of the cutting cylinder B. That is, the interval signal Sa assumes the ON and OFF levels one time each during a single rotation of the cutting cylinder; in other words, the level of the interval signal Sa changes between the ON and OFF levels according to cutting intervals of the cutting cylinder B.

Since every jaw mechanism Da of the jaw cylinder D grips one signature M; i.e., all of the reflection plates 2 are covered with corresponding signatures M, a light beam emitted from the light emitter in the light emission-reception surface 12 of the photoelectric sensor 1 is not reflected by the reflection plate 2, and thus the light receiver does not detect reflected light. Therefore, the reflection plate detection signal 1*a* is not output; i.e., the signal 1*a* is maintained at the OFF level.

FIG. 5A(2) shows a timing chart for the case where paper jam has occurred in the folding machine Q which is operated in the straight run mode. When paper jam occurs upstream of the jaw cylinder D, in due course the jaw mechanisms Da of the jaw cylinder D fail to grip signatures M. Since there is established a state in which none of the reflection plates 2 is covered with signature M, after occurrence of paper jam, light emitted from the light emitter in the light emission-reception surface 12 of the photoelectric sensor 1 is reflected by every reflection plate 2, and thus the light receiver detects reflected light. As a result, the reflection plate detection signal 1*a* assumes the ON level for all of the reflection plates 2.

In straight run, the paper jam signal output section for straight run of the control unit T receives from the interval signal generator S the interval signal Sa which assumes the ON and OFF levels alternately. Each of the ON and OFF levels of the interval signal Sa is used for judgement as to whether the AND condition is satisfied. That is, when the reflection plate detection signal 1*a* (ON level) from the photoelectric sensor 1 is input to the control unit T, the paper jam signal output section for straight run judges that the AND condition is satisfied, irrespective of the level of the interval signal Sa; i.e., whether the interval signal Sa is at the ON level or the OFF level, and judges that a paper jam has occurred.

Upon detection of paper jam, the control unit T outputs a paper jam signal Ta (ON level) at the timing of the leading edge or trailing edge of the interval signal Sa subsequent to the detection of paper jam.

2. Detection of Paper Jam in Collect Run (FIG. 5B)

Figure 5B:
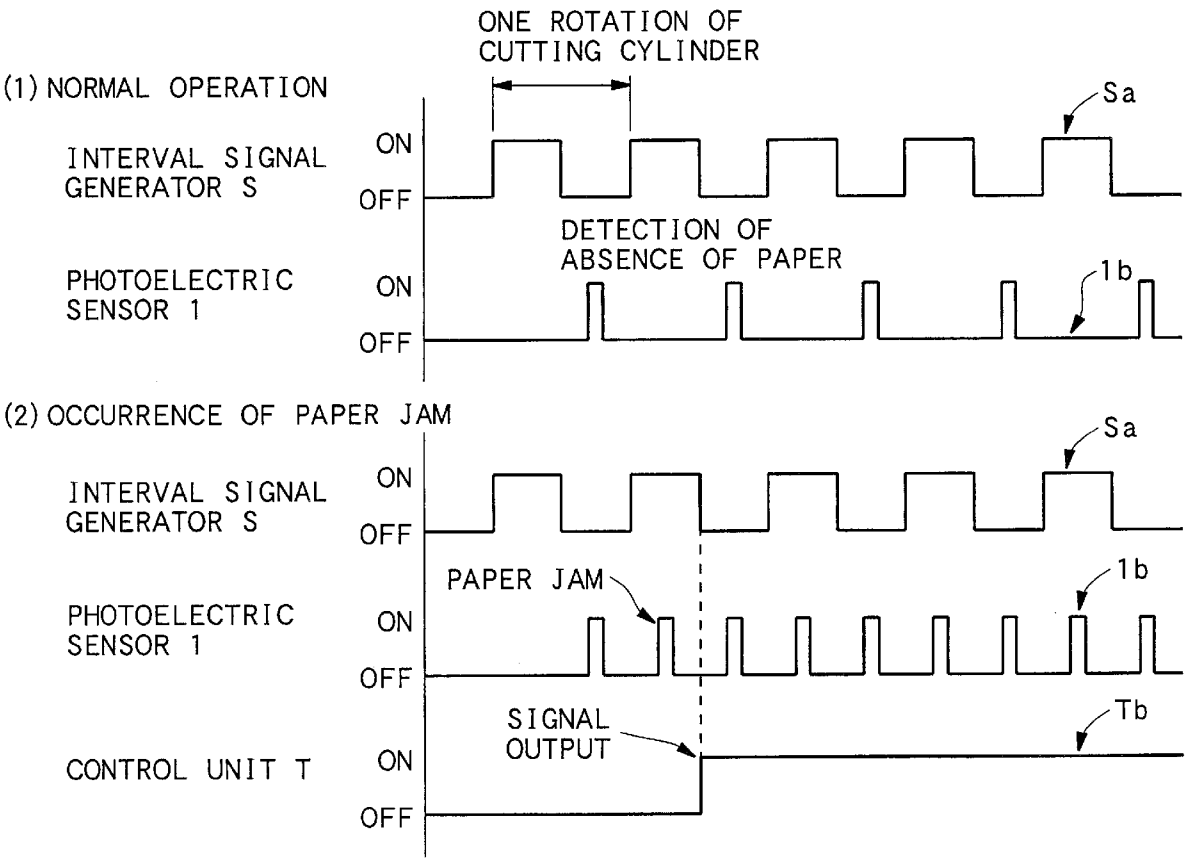

FIG. 5B(1) shows a timing chart for the case where the folding machine Q operates normally in the collect run mode. The proximity switch 31 of the interval signal generator S outputs a proximity detection signal, which serves as the interval signal Sa and assumes ON and OFF levels alternately at intervals corresponding to one-half rotation of the cutting cylinder B. That is, the interval signal Sa assumes the ON and OFF levels one time each during a single rotation of the cutting cylinder; in other words, the output level of the interval signal Sa changes between the ON and OFF levels according to cutting intervals of the cutting cylinder B.

Since every other jaw mechanism Da of the jaw cylinder D grips a signature M; i.e., every other reflection plate 2 is not covered with signature M, a light beam emitted from the light emitter in the light emission-reception surface 12 of the photoelectric sensor 1 is reflected by every other reflection plate 2, and the light receiver detects the reflected light. Therefore, the reflection plate detection signal 1*b* assumes the ON and OFF levels alternately for a series of the reflection plates 2.

The paper jam signal output section for collect run judges occurrence of jamming of sheet P on the basis of the ON level of the interval signal Sa and the ON level of the reflection plate detection signal 1*b*. Since the ON level of the interval signal Sa is selectively used for judgement as to whether the AND condition is satisfied, the reflection plate detection signal 1*b* (ON level) is output at timings corresponding to the OFF periods of the interval signal Sa.

FIG. 5B(2) shows a timing chart for the case where paper jam has occurred in the folding machine Q which is operated in the collect run mode. When paper jam occurs upstream of the jaw cylinder D, in due course the jaw mechanisms Da of the jaw cylinder D fail to grip signatures M. Since there is established a state in which none of the reflection plates 2 is covered with signature M, after occurrence of paper jam, light emitted from the light emitter in the light emission-reception surface 12 of the photoelectric sensor 1 is reflected by every reflection plate 2, and thus the light receiver detects reflected light. As a result, the output reflection plate detection signal 1*a* assumes the ON level for all of the reflection plates 2.

In collect run, the paper jam signal output section for collect run of the control unit T receives from the interval signal generator S the interval signal Sa, which assumes the ON and OFF levels alternately.

As described above, the ON level of the interval signal Sa is selectively used for judgement as to whether the AND condition is satisfied. Therefore, in the case in which the reflection plate detection signal 1*a* (ON level) from the photoelectric sensor 1 is input to the control unit T when the interval signal Sa is at the ON level, the paper jam signal output section for collect run judges that the AND condition is satisfied, and judges that a paper jam has occurred.

Upon detection of paper jam, the control unit T outputs a paper jam signal Tb (ON level) at the timing of the trailing edge of the interval signal Sa subsequent to the detection of paper jam.

As described above, the control unit T detects occurrence of paper jam and outputs the paper jam signal Ta or Tb.

The paper jam signal Ta or Tb output from the corresponding paper jam signal output section of the control unit T is input to an unillustrated processing unit, whereby a paper jam elimination mechanism; for example, an appropriate mechanism (not shown) for moving the paper guide 26 or E away from the cylinder surface which the guide faces is operated, and the rotary press is stopped.

Notably, the control unit T may employ a paper jam signal output section which assumes a configuration similar to that of the collect run paper jam signal output section and is adapted to detect both paper jam in straight run and paper jam in collect run.

In this case, the ON or OFF level of the interval signal Sa output from the interval signal generator S is selectively used for judgement as to whether the AND condition is satisfied. For example, in the case where, as described above, only the ON level of interval signal Sa is used for judgement as to whether the AND condition is satisfied, when the reflection detection signal 1*a* (ON level) is output in response to occurrence of paper jam during the duration when the interval signal Sa is at the OFF level, the control unit T does not output the paper jam signal Ta (ON level) indicative of paper jam at the timing of the leading edge of the interval signal Sa (from the OFF level to the ON level) subsequent to the detection of paper jam, but outputs the paper jam signal Ta (ON level) at the timing of the trailing edge of the interval signal Sa (from the ON level to the OFF level) subsequent to the detection of paper jam.

Obviously, numerous modifications and variations of the present invention are possible in light of the above teachings. It is therefore to be understood that within the scope of the appended claims, the present invention may be practiced otherwise than as specifically described herein.

What is claimed is:

1. A paper jam detection system for a folding machine, in which a folding cylinder, a cutting cylinder, and a jaw cylinder are disposed such that an outer circumferential surface of the cutting cylinder and an outer circumferential surface of the jaw cylinder face an outer circumferential surface of the folding cylinder with gaps held therebetween for allowing passage of paper; axially extending knives project from the outer circumferential surface of the cutting cylinder; pairs each consisting of a cutting shoulder and a pin are circumferentially arranged at an outer circumferential surface portion of the folding cylinder such that the cutting shoulders are arranged at circumferential intervals corresponding to those of the knives of the cutting cylinder and such that the pins are located adjacent to and behind the corresponding cutting shoulders in relation to a rotational direction of the folding cylinder and can project from and retract behind the outer circumferential surface of the folding cylinder; each of axially extending tucker blades is circumferentially arranged at a substantially circumferentially central position between neighboring cutting shoulders in such a manner as to be able to project from and retract behind the outer circumferential surface of the folding cylinder; jaw mechanisms are circumferentially arranged at an outer circumferential surface portion of the jaw cylinder at circumferential intervals corresponding to those of the knives of the cutting cylinder; a paper guide is provided to define a sheet transfer space together with the outer circumferential surface of the folding cylinder and the outer circumferential surface of the jaw cylinder and guide a two-folded signature gripped by the jaw mechanism; and the knife and the cutting shoulder cooperatively cut off a sheet of predetermined length from a web, while the jaw mechanism and the tucker blade cooperatively fold the sheet; said paper jam detection system comprising:

an interval signal generator for generating an interval signal which assumes alternately ON and OFF levels according to cutting intervals of the cutting cylinder;

a signature detection mechanism comprising reflection plates each having a light reflection surface and being provided at an outer circumferential surface portion of the jaw cylinder adjacent to and behind the corresponding jaw mechanism in relation to the rotational direction of the jaw cylinder such that the light reflection surface does not project beyond a contour of the outer circumferential surface of the jaw cylinder; and a photoelectric sensor adapted to generate a reflection plate detection signal upon detection of the reflection plate and located downstream, in relation to the rotational direction of the jaw cylinder, of an end of the paper guide on a side toward the jaw cylinder at a position suited for detecting the reflection plate with a gap held between the photoelectric sensor and the outer circumferential surface of the jaw cylinder; and a control unit for outputting a paper jam signal on the basis of the interval signal from the interval signal generator and the reflection plate detection signal from the photoelectric sensor.

2. A paper jam detection system for a folding machine according to claim 1, wherein the control unit comprises a paper jam signal output section for a straight-run folding mode and a paper jam signal output section for a collect-run folding mode, and selectively uses the paper jam signal output sections according to a folding mode.

3. A paper jam detection system for a folding machine according to claim 2, wherein the paper jam signal output section for the straight-run folding mode judges occurrence of paper jam on the basis of ON and OFF levels of the interval signal and an ON level of the reflection plate, and the paper jam signal output section for the collect-run folding mode judges occurrence of paper jam on the basis of the ON level of the interval signal and the ON level of the reflection plate detection signal.

4. A paper jam detection system for a folding machine according to claim 2, further comprising a detection circuit changeover unit for outputting to the control unit an instruction signal for instructing the control unit to select the paper jam signal output section for the straight-run folding mode or the paper jam signal output section for the collect-run folding mode.

5. A paper jam detection system for a folding machine according to claim 3, further comprising a detection circuit changeover unit for outputting to the control unit an instruction signal for instructing the control unit to select the paper jam signal output section for the straight-run folding mode or the paper jam signal output section for the collect-run folding mode.

6. A paper jam detection system for a folding machine according to any one of claims 1 to 5, wherein the photoelectric sensor comprises a cover whose bottom panel faces a light emission-reception surface of the photoelectric sensor and has an opening formed therein for allowing passage of light and whose side panel has an air nozzle formed therein for allowing air from an air supply to impinge on the light emission-reception surface.

* * * * *